US005224456A

United States Patent [19]

Hosoda et al.

[11] Patent Number: 5,224,456

[45] Date of Patent: Jul. 6, 1993

[54] STARTING FUEL SUPPLY CONTROL SYSTEM FOR INTERNAL COMBUSTION ENGINES

[75] Inventors: Fumio Hosoda; Hideo Moriwaki; Masakazu Kitamoto; Sachito Fujimoto; Kazumi Yamazaki; Takashi Kiyomura, all of Wako, Japan

[73] Assignee: Honda Giken Kogyo Kabushiki Kaisha, Tokyo, Japan

[21] Appl. No.: 876,981

[22] Filed: May 1, 1992

[30] Foreign Application Priority Data

May 31, 1991 [JP] Japan ..... 3-155257

[51] Int. Cl.[5] ..... F02M 33/02

[52] U.S. Cl. ..... 123/520; 123/179.16; 123/491

[58] Field of Search ..... 123/520, 179.16, 491, 123/179 G, 198 D, 519, 518, DIG. 2

[56] References Cited

U.S. PATENT DOCUMENTS

| | | | |
|---|---|---|---|
| 4,765,300 | 8/1988 | Fujimura et al. | 123/491 |
| 4,773,378 | 9/1988 | Fujimura et al. | 123/491 |
| 4,844,039 | 7/1989 | Osaki et al. | 123/491 |
| 4,867,126 | 9/1989 | Yonekawa et al. | 123/179.16 |
| 4,875,443 | 10/1989 | Sano et al. | 123/179 G |
| 4,953,514 | 9/1990 | Beicht et al. | 123/520 |
| 5,048,493 | 9/1991 | Orzel et al. | 123/520 |
| 5,067,489 | 11/1991 | Hamburg | 123/520 |
| 5,103,794 | 4/1992 | Shiraishi | 123/520 |

FOREIGN PATENT DOCUMENTS 57-206738 12/1982 Japan .

*Primary Examiner*—Raymond A. Nelli

*Attorney, Agent, or Firm*—Nikaido, Marmelstein, Murray & Oram

[57] ABSTRACT

A starting fuel supply control system for an internal combustion engine having a purging passage connecting between a canister and an intake passage for purging a mixture of evaporative fuel from a fuel tank and air therethrough into the intake passage, and a purge control valve arranged across the purging passage for controlling the flow rate of the evaporative fuel to be supplied to the intake passage. An ECU detects a flow rate of an evaporative fuel component in the mixture flowing in the purging passage, and sets an amount of fuel to be supplied to the engine at the start thereof, based upon the detected flow rate of the evaporative fuel component.

5 Claims, 9 Drawing Sheets

FIG.12

| | θ TH0 | θ TH1 | ····· | θ TH15 |
|---|---|---|---|---|
| PBA0 | PCQO(0,0) | PCQO(0,1) | ····· | PCQO(0,15) |
| PBA1 | PCQO(1,0) | PCQO(1,1) | ····· | PCQO(1,15) |
| ⋮ | ⋮ | ⋮ | ⋱ | ⋮ |
| PBA15 | PCQO(15,0) | PCQO(15,1) | ····· | PCQO(15,15) |

FIG.13

| | | | |
|---|---|---|---|
| VS0 | VS1 | ····· | VS15 |
| η Q0 | η Q1 | ····· | η Q15 |

FIG.14

| | PCQ 1−0 | PCQ 1−1 | ····· | PCQ 1−15 |
|---|---|---|---|---|
| QH0 | VQ(0,0) | VQ(0,1) | ····· | VQ(0,15) |
| QH1 | VQ(1,0) | VQ(1,1) | ····· | VQ(1,15) |
| ⋮ | ⋮ | ⋮ | ⋱ | ⋮ |
| QH15 | VQ(15,0) | VQ(15,1) | ····· | VQ(15,15) |

STARTING FUEL SUPPLY CONTROL SYSTEM FOR INTERNAL COMBUSTION ENGINES

BACKGROUND OF THE INVENTION

1. Field of the Invention

The present invention relates to a starting fuel supply control system for internal combustion engines, and more particularly to a starting fuel supply control system which controls the fuel supply to an internal combustion engine equipped with an evaporative emission control system, at the start of the engine.

2. Prior Art

Conventionally, a fuel supply control system for internal combustion engines, is known, e.g. by Provisional Patent Publication (Kokai) No. 57-206738, which operate to determine an amount of fuel supplied to the engine, by correcting a basic fuel amount set depending upon the temperature of the engine, by a correction coefficient set depending upon the rotational speed of the engine.

On the other hand, an evaporative fuel-purging control system for internal combustion engines is widely used, which includes a canister for adsorbing evaporative fuel generated from the fuel tank, a purging passage connecting between the canister and the intake passage for purging a mixture of the evaporative fuel and air therethrough into the intake passage, and a purge control valve arranged across the purging passage for controlling the flow rate of the evaporative fuel supplied to the intake passage.

As is generally known, part of fuel injected into the intake pipe of an internal combustion engine is attached to inner walls of the intake pipe without being gasified or vaporized. The amount of fuel attached to the inner walls is large particularly at the start of the engine and before completion of warming-up of the engine. To compensate for the attached fuel amount, the above-mentioned conventional fuel supply control system is designed to inject a larger amount of fuel than the amount actually required by the engine.

However, the injection of such an excessive amount of fuel causes emission of an unburnt component (HC) in large quantities, resulting in degraded exhaust emission characteristics, as well as in increased fuel consumption.

SUMMARY OF THE INVENTION

It is the object of the invention to provide a starting fuel supply control system for an internal combustion engine, which is capable of reducing the amount of emission of HC and the fuel consumption by controlling the fuel supply to the engine at the start thereof in a manner depending upon the purging amount of evaporative fuel.

To attain the above object, the present invention provides a starting fuel supply control system for an internal combustion engine having a fuel tank, an intake passage, a canister for adsorbing evaporative fuel generated from the fuel tank, a purging passage connecting between the canister and the intake passage for purging a mixture of the evaporative fuel and air therethrough into the intake passage, and a purge control valve arranged across the purging passage for controlling a flow rate of the evaporative fuel to be supplied to the intake passage.

The starting fuel supply control system according to the invention is characterized by comprising:

evaporative fuel flow rate-detecting means for detecting a flow rate of an evaporative fuel component in the mixture flowing in the purging passage; and starting fuel amount-setting means for setting an amount of fuel to be supplied to the engine at the start thereof, based upon the detected flow rate of the evaporative fuel component.

Preferably, the starting fuel supply control system includes engine operating parameter-detecting means for detecting values of a plurality of operating parameters of the engine, mixture flow rate-calculating means for calculating a flow rate of the mixture, based upon the detected values of the operating parameters of the engine, and a mass flowmeter arranged across the purging passage, and wherein the evaporative fuel flow rate-detecting means detects the flow rate of the evaporative fuel component in the mixture, based upon the calculated flow rate of the mixture and an output value of the mass flowmeter.

Also preferably, the starting fuel supply control system includes injecting means for injecting fuel into the intake passage, and wherein the starting fuel amount-setting means sets the amount of fuel to be supplied to the engine at the start thereof by setting to zero an amount of fuel to be injected by the injecting means and controlling the purge control valve alone when the detected flow rate of the evaporative fuel component in the mixture exceeds a flow rate required for an operating condition of the engine at the start thereof, and by controlling both the purge control valve and the injecting means when the detected flow rate of the evaporative fuel component exceeds the required flow rate.

The above and other objects, feature and advantages of the invention will become more apparent from the following detailed description taken in conjunction with the accompanying drawings.

BRIEF DESCRIPTION OF THE DRAWINGS

FIG. 12 shows a map for determining the basic PC flow rate PCQ0;

FIG. 13 shows a table for determining a flow rate ratio $\eta$Q; and

FIG. 14 shows a map for determining the vapor concentration VQ.

DETAILED DESCRIPTION

The invention will now be described in detail with reference to the drawings showing an embodiment thereof.

Figure 1:
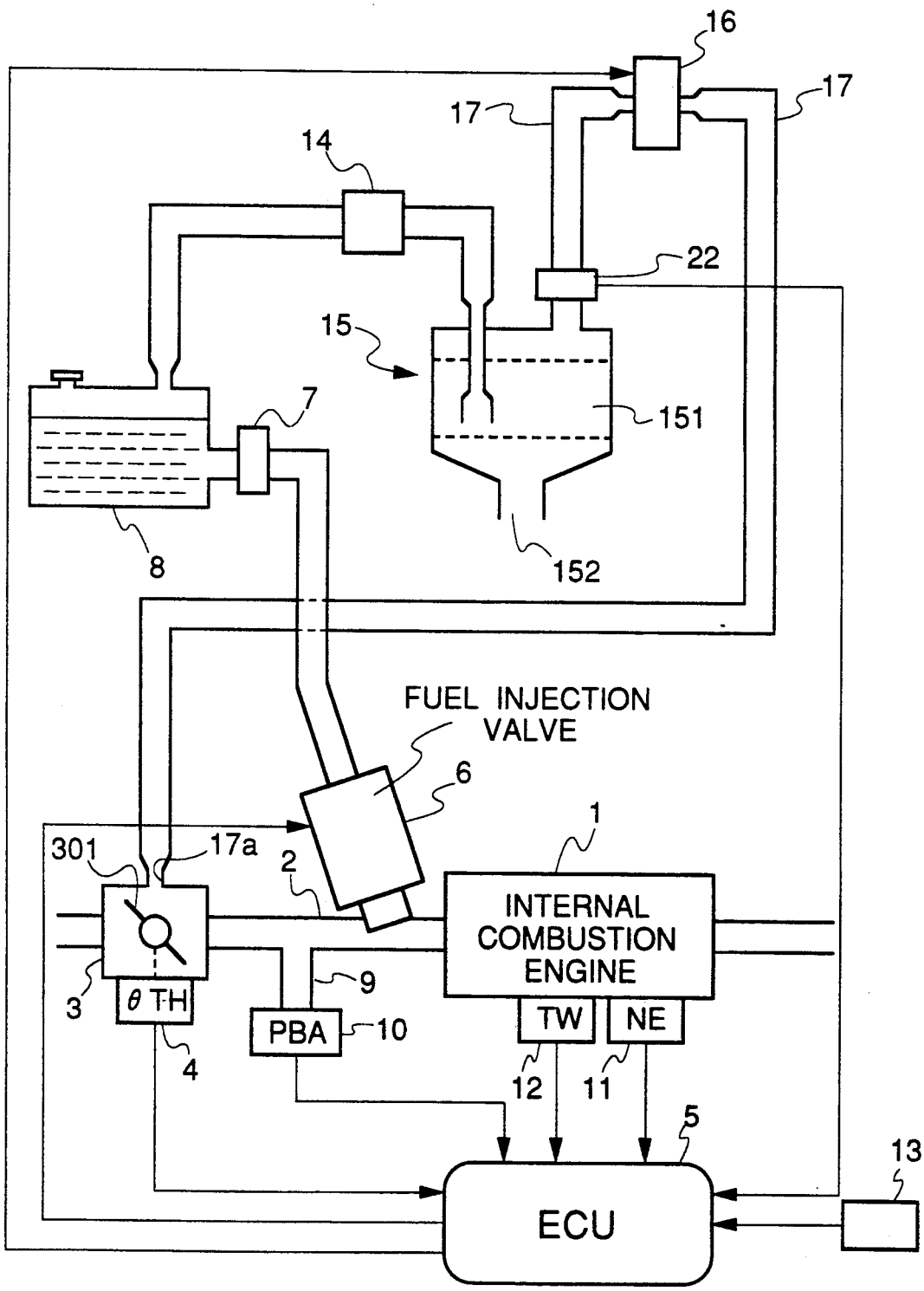
FIG. 1 is a schematic block view showing the arrangement of a starting fuel supply control system and an internal combustion engine employing the shine, according to an embodiment of the invention.

Referring first to FIG. 1, there is illustrated the whole arrangement of a starting fuel supply control system for an internal combustion engine, according to an embodiment of the invention. In the figure, reference numeral 1 designates an internal combustion engine which is installed in an automotive vehicle, not shown. The engine is a four-cylinder type, for instance. Connected to the cylinder block of the engine 1 is an intake pipe 2 across which is arranged a throttle body 3 accommodating a throttle valve 301 therein. A throttle valve opening ($\theta$TH) sensor 4 is connected to the throttle valve 301 for generating an electric signal indicative of the sensed throttle valve opening and supplying same to an electronic control unit (hereinafter called "the ECU") 5. The ECU 5 forms part of evaporative fuel flow rate detecting means and starting fuel amount-setting means.

Fuel injection valves 6, only one of which is shown, are inserted into the interior of the intake pipe 2 at locations intermediate between the cylinder block of the engine 1 and the throttle valve 301 and slightly upstream of respective intake valves, not shown. The fuel injection valves 6 are connected to a fuel tank 8 via a fuel pump 7, and electrically connected to the ECU 5 to have their valve opening periods controlled by signals therefrom.

On the other hand, an intake pipe absolute pressure (PBA) sensor 10 is provided in communication with the interior of the intake pipe 2 via a conduit 9 at a location immediately downstream of the throttle valve 301 for supplying an electric signal indicative of the sensed absolute pressure within the intake pipe 2 to the ECU 5.

An engine rotational speed (NE) sensor 11 is arranged in facing relation to a camshaft or a crankshaft of the engine 1, not shown. The engine rotational speed sensor 11 generates a pulse as a TDC signal pulse at each of predetermined crank angles whenever the crankshaft rotates through 180 degrees, the pulse being supplied to the ECU 5.

An engine coolant temperature sensor 12 is inserted into the wall of a cylinder of the engine filled with engine coolant, which is formed of a thermistor or the like, for supplying an electric signal indicative of the sensed engine coolant temperature to the ECU 5.

A starting switch 13 is connected to the ECU 5, for turning on and off an engine starting motor, not shown.

A conduit line (purging passage) 17 extends from an upper space in the fuel tank 8 which has an enclosed body, and opens into the intake pipe 2 at a location downstream of the throttle body 3. Arranged across the conduit line 17 is an evaporative emission control system (part of the evaporative fuel-purging control system) comprising a two-way valve 14, a canister 15 having an adsorbent 151, and a purge control valve (EPCV) 16 formed by a linear control valve which has a solenoid, not shown, for driving a valve element thereof, not shown. The solenoid of the purge control valve 16 is connected to the ECU 5 and controlled by a signal supplied therefrom to change the valve opening (EACV) linearly. According to this evaporative emission control system, evaporative fuel or fuel vapor (hereinafter merely referred to as "evaporative fuel") generated within the fuel tank 8 forcibly opens a positive pressure valve, not shown, of the two-way valve 14 when the pressure of the evaporative fuel reaches a predetermined level, to flow through the valve 14 into the canister 15, where the evaporative fuel is adsorbed by the adsorbent 151 in the canister and thus stored therein. The purge control valve 16 is closed when its solenoid is not energized by the control signal from the ECU 5, whereas it is opened when the solenoid is energized, whereby negative pressure in the intake pipe 2 causes evaporative fuel temporarily stored in the canister 15 to flow therefrom together with fresh air introduced through an outside air-introducing port 152 of the canister 15 at the flow rate determined by the valve opening of the purge control valve 16 corresponding to the current amount of the signal applied thereto, through the purging passage 17 into the intake pipe 2 to be supplied to the cylinders. When the fuel tank 8 is cooled due to low ambient temperature, etc. so that negative pressure increases within the fuel tank 8, a negative pressure valve, not shown, of the two-way valve 14 is opened to return part of the evaporative fuel stored in the canister 15 into the fuel tank 8. In the above described manner, the evaporative fuel generated within the fuel tank 8 is prevented from being emitted into the atmosphere. Further, a mass flowmeter 22 is arranged across the conduit line (purging passage) 17 at a location between the canister 15 and the purge control valve 16, which detects the flow rate of a mixture of evaporative fuel and air flowing in the conduct line 17 (purging flow rate) and supplies a signal indicative of the detected value of the purging flow rate to the ECU 5. The mass flowmeter 22 is a hot wire type which utilizes the nature of a platinum wire that when the platinum wire is heated by electric current applied thereto and at the same time exposed to a flow of gas, the platinum wire loses its heat to decrease in temperature so that its electric resistance decreases. Alternatively, the mass flowmeter 22 may be a thermo type comprising a thermistor of which the electric resistance varies due to self-heating by electric current applied thereto or a change in the ambient temperature. Both the types of mass flowmeter detect variation in the concentration of evaporative fuel through variation in the electric resistance thereof.

The end of the purging passage 17 opening into the intake pipe 2 is formed as a PC port (purge-control port) 17*a* which is located such that when the throttle valve 301 is open, it is positioned downstream of the valve element, while when the throttle valve 301 is closed, it is positioned upstream of the valve element. The term "PC flow rate", used hereinafter, means a flow rate of a mixture of evaporative fuel and air, which is calculated according to the throttle valve opening $\theta$TH and the intake pipe absolute pressure PBA. When air alone is flowing in the purging passage 17, i.e. when the concentration of evaporative fuel (hereinafter called "vapor concentration) is 0%, the PC flow rate is equal to the purging flow rate (the actual flow rate of the mixture of evaporative fuel and air) TQ, while when the vapor concentration is not 0%, the former is maintained in predetermined relationship with the latter, as hereinafter described.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") which executes programs for calculating a fuel injection period Tout, referred to hereinafter, and the valve opening amount (EPCV), etc., memory means storing maps and tables, referred to hereinafter, and the programs executed by the CPU and for storing results of calculations therefrom, etc., and an output circuit which outputs driving signals to the fuel injection valves 6 and the purge control valve 16.

The CPU operates in response to the above-mentioned engine parameter signals from the sensors to determine operating conditions in which the engine 1 is operating, and calculates, based upon the determined operating conditions, the valve opening amount (EPCV value) of the purge control valve 16 and the valve opening period or fuel injection period Tout over which the fuel injection valves 6 are to be opened, according to a program shown in FIG. 2, hereinafter described, in synchronism with inputting of TDC signal pulses to the ECU 5, when the engine is being started.

The CPU supplies, through the output circuit, the purge control valve 16 and the fuel injection valves 6 with driving signals corresponding to the calculated EPCV value and the calculated fuel injection period Tout, for opening the EPCV 16 and the fuel injection valves 6 thereby.

Figure 2:
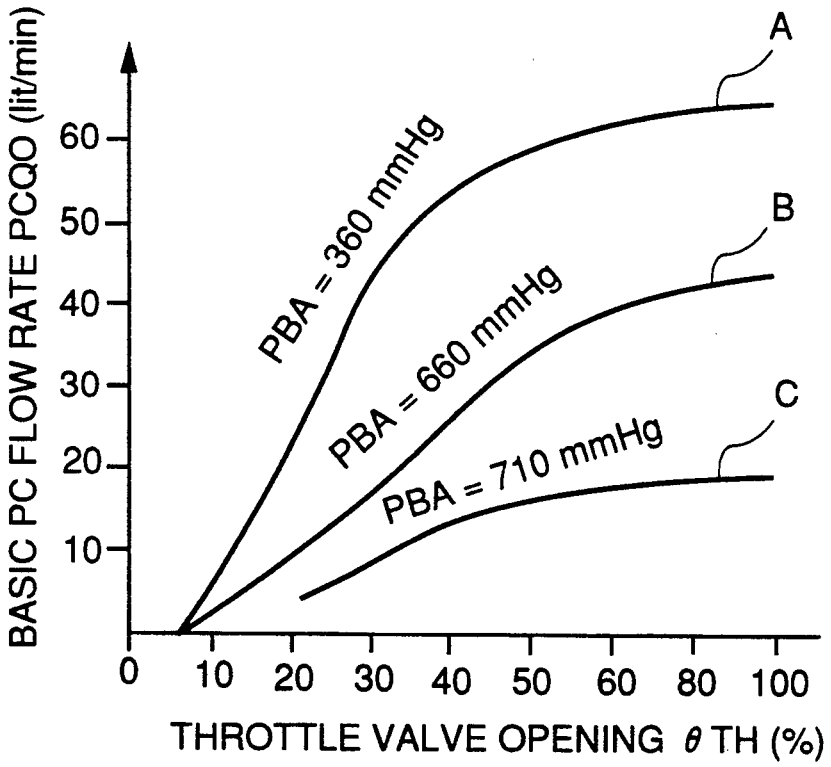
FIG. 2 is a graph showing the relationship between throttle valve opening $\theta$TH and intake pipe absolute pressure PBA, and a basic PC flow rate PCQ0.

FIG. 2 shows the relationship between the throttle valve opening $\theta$TH (%) and a basic PC flow rate PCQ0 (l/min), which holds when the vapor concentration $\beta$ is 0% (i.e. the air concentration is 100%). In the figure, the curves A, B, and C correspond, respectively, to different values of the intake pipe absolute pressure PBA, i.e. 360 mmHg, 660 mmHg, and 710 mmHg. The basic PC flow rate PCQ0 represents a value of the PC flow rate assumed when the purge control valve 16 is fully open. By the use of the relationship of FIG. 2, the basic PC flow rate PCQ0 is calculated according to the throttle valve opening $\theta$TH and the intake pipe absolute pressure PBA.

Figure 3:
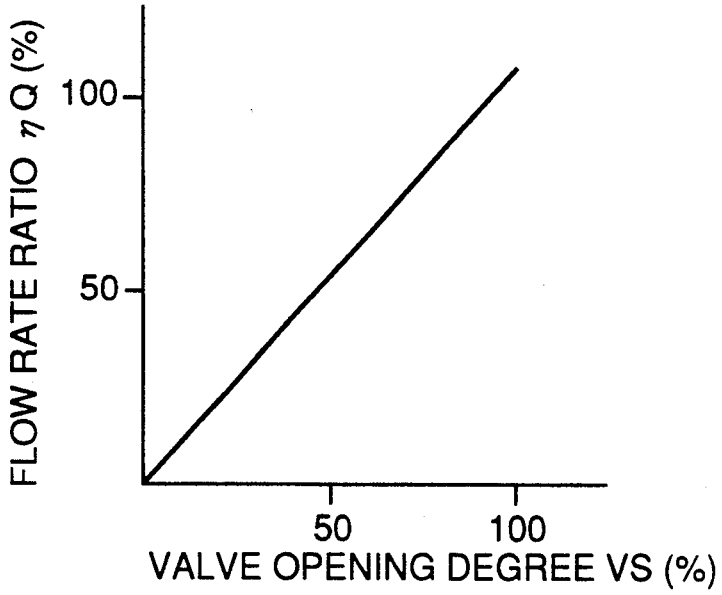
FIG. 3 is a graph showing a flow rate characteristic of a conduit line (purging passage) 17 appearing in FIG. 1.

FIG. 3 shows the flow rate characteristic of the purge control valve 16. In the figure, the flow rate ratio $\eta$Q (%) represents the ratio of the PC flow rate to its maximum value, which is determined by the valve opening degree VS (%) of the purge control valve 16. The PC flow rate PCQ1 is obtained by multiplying the basic PC flow rate PCQ0 by the flow rate ratio $\eta$Q.

Figure 4:
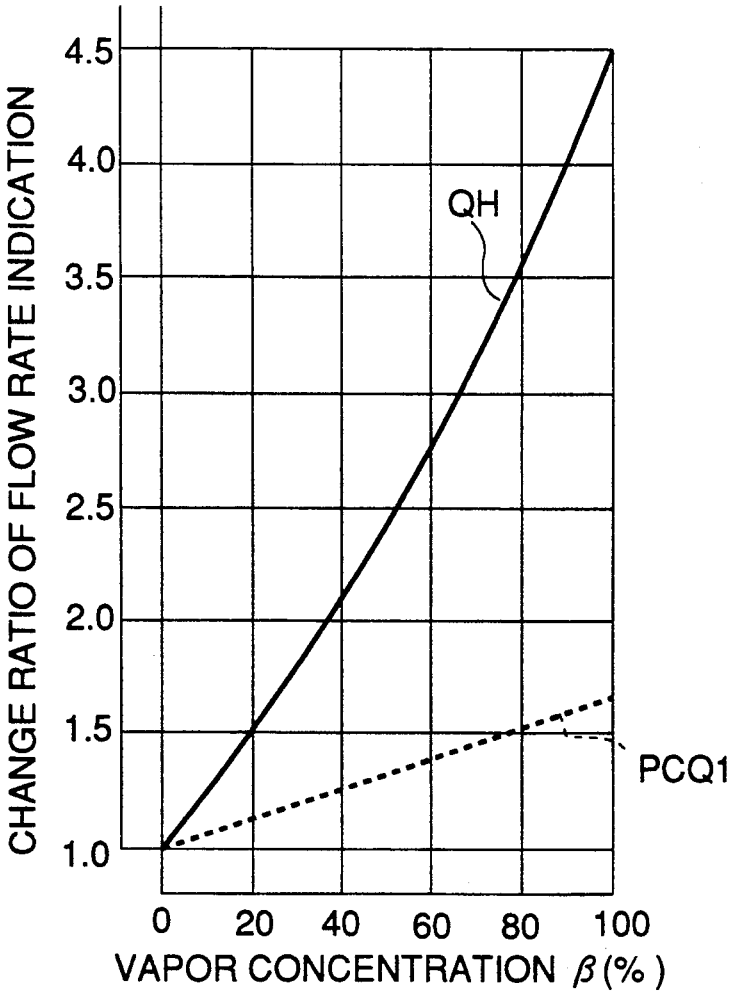
FIG. 4 is a graph showing the relationship between vapor concentration $\beta$ and a change ratio of flow rate indication.

FIG. 4 shows the relationship between the vapor concentration $\beta$ in the mixture and a change ratio of flow rate indication. In the figure, the solid line curve represents the output value QH of the hot-wire type mass flowmeter 22, and the broken line curve the PC flow rate PCQ1.

Figure 5A:
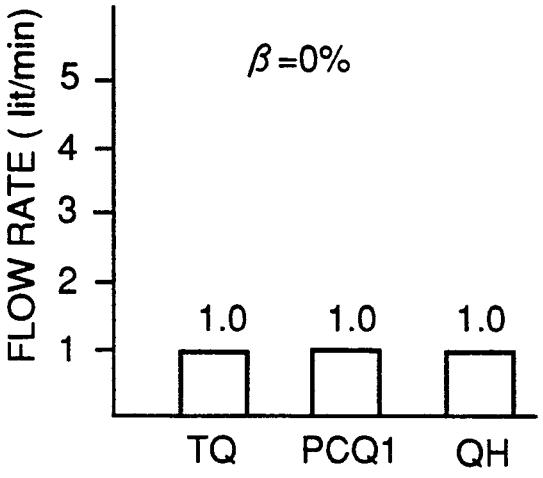
FIGS. 5A and 5B are a graph showing the relationship between a PC flow rate PCQ1 and an output value QH from a hot-wire type flowmeter appearing in FIG. 1.
Figure 5B:
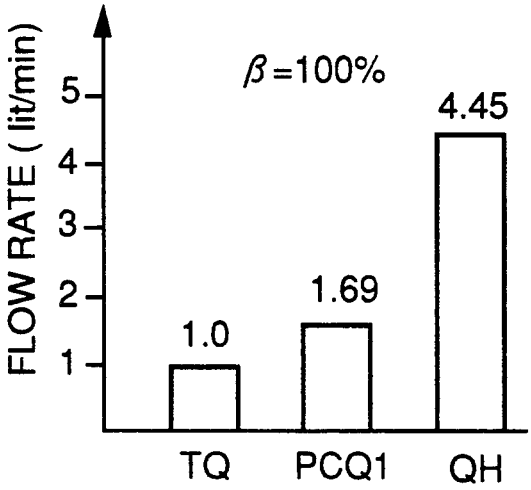
Figure 6:
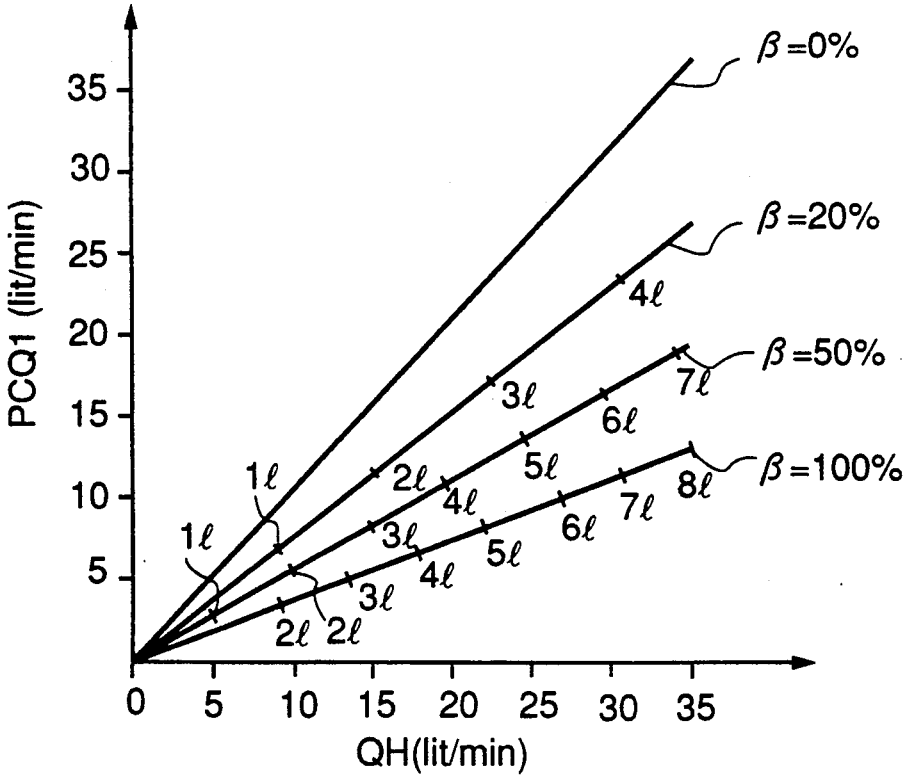
FIG. 6 is a graph showing the relationship between the PC flow rate PCQ1, the output value QH, vapor flow rate VQ', and the vapor concentration $\beta$.

The change ratio of flow rate indication represents the ratio of an indicated flow rate value (i.e. the QH value or the PCQ1 value) obtained when $\beta>0\%$ to one obtained when $\beta=0\%$, provided that the purging flow rate TQ is held constant. In order words, the change ratio of flow rate indication represents the ratio of the QH value or the PCQ1 value to the purging flow rate TQ, i.e. $\theta$H/TQ or PCQ1/TQ. For example, when $\beta=0\%$, the relationship of PCQ1=QH=TQ=1 (l/min) holds, as shown in (a) of FIG. 5, whereas when $\beta=100\%$, the relationships of PCQ1=1.69 (l/min) and QH=4.45 (l/min) hold while TQ=1 (l/min). Therefore, by the use of the relationship of FIG. 4, the vapor concentration $\beta$, the vapor flow rate VQ, and the purging flow rate TQ can be calculated according to the PC flow rate PCQ1 and the output value QH from the hot-wire type mass flowmeter 11. More specifically, the relationship between QH, PCQ1, $\beta$, and VQ can be represented in a graph shown in FIG. 6. By the use of the relationship of FIG. 6, the vapor concentration $\beta$, the vapor flow rate VQ, and the purging flow rate TQ can be determined from the QH value and the PCQ1 value. In the figure, the VQ value is indicated by 1 l, 2 l, . . . on the $\beta$ lines, and the TQ value can be obtained from VQ/$\beta$.

Figure 8:
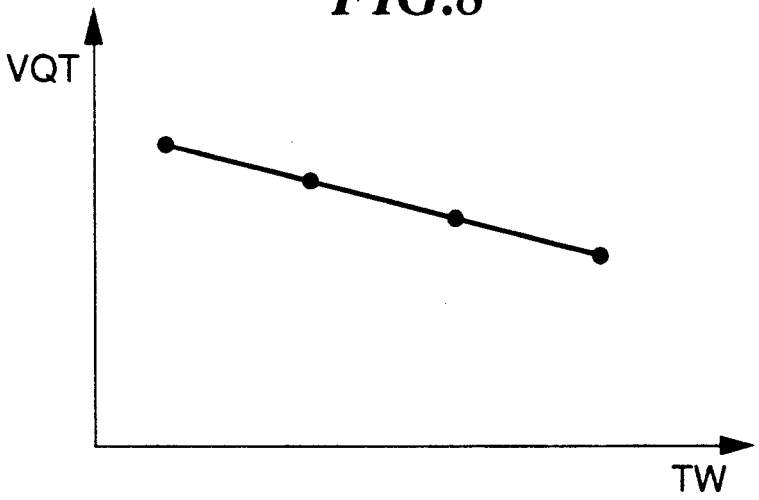
FIG. 8 shows the relationship between a starting reference vapor flow rate rate VQF and engine coolant temperature TW, which is set in a VQT table.

FIG. 8 shows a program for calculating the fuel injection period Tout and the EPCV value, i.e. the valve opening amount of the purge control valve 16, at the start of the engine. The EPCV value is set such that as the EPCV value is larger, the valve opening of the purge control valve 16 increases to thereby cause an increase in the flow rate of the mixture through the purging passage 17.

Figure 7A:
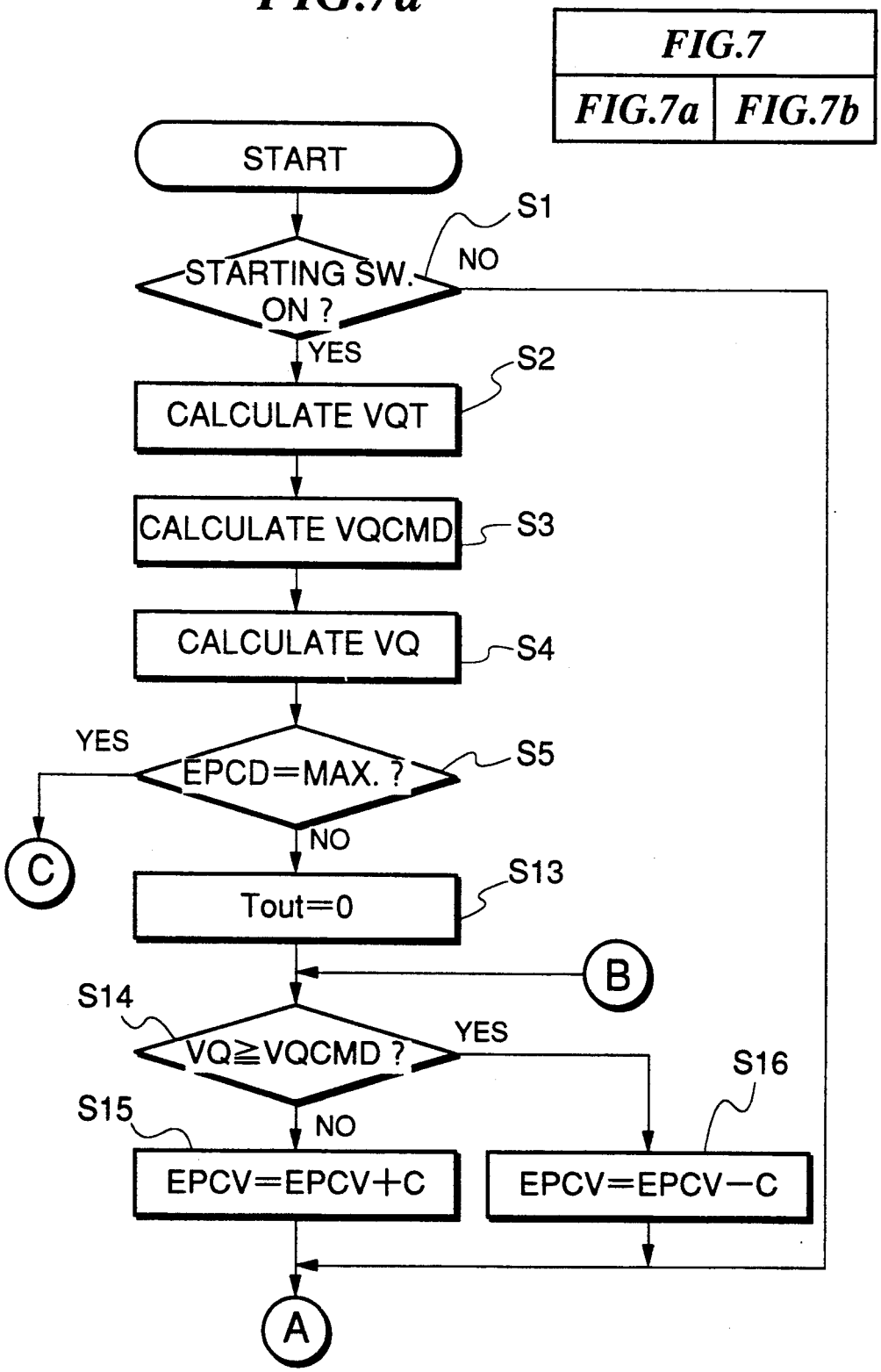
FIG. 7 is a flowchart showing a program for effecting the fuel supply control at the start of the engine.
Figure 7B:
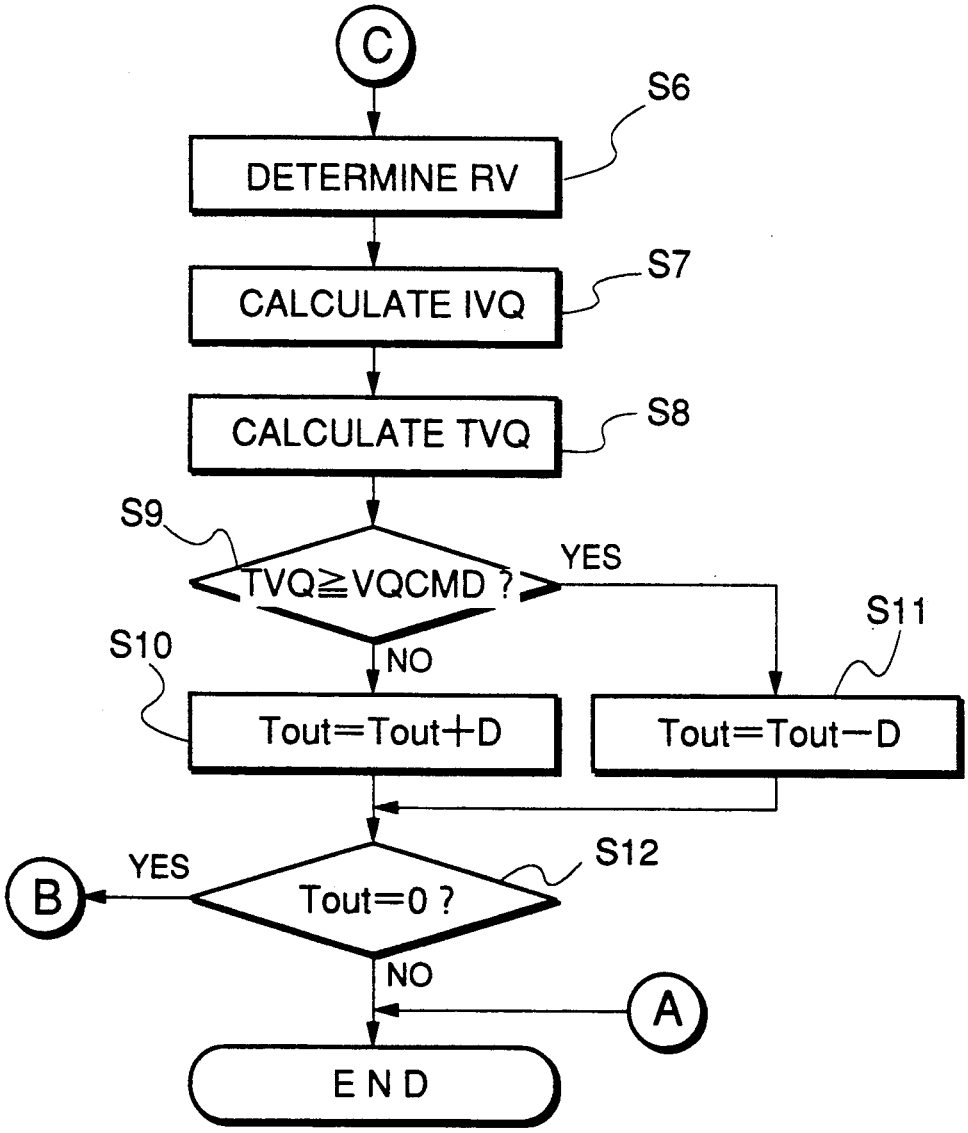
Figure 9:
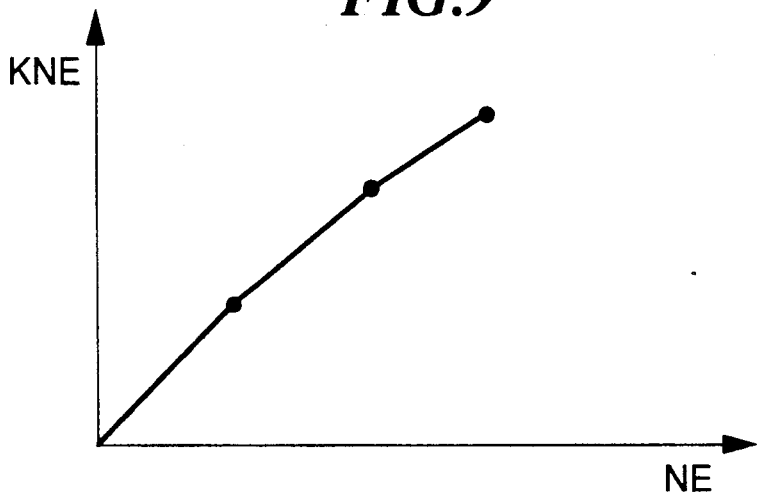
FIG. 9 shows the relationship between an engine speed-dependent correction coefficient KNE and the engine rotational speed NE, which is set in a KXE table.

In FIG. 7, first at a step S1, it is determined whether or not the starting switch 13 is closed. If the answer is negative (No), the program is immediately terminated, whereas if the answer is affirmative (Yes), a starting reference vapor flow rate VQT is calculated according to the engine coolant temperature TW, at a step S2. The starting reference vapor flow rate VQT is read from a VQT table which is set such that it is set to smaller values as the engine coolant temperature TW becomes lower, as shown in FIG. 9.

Figure 10:
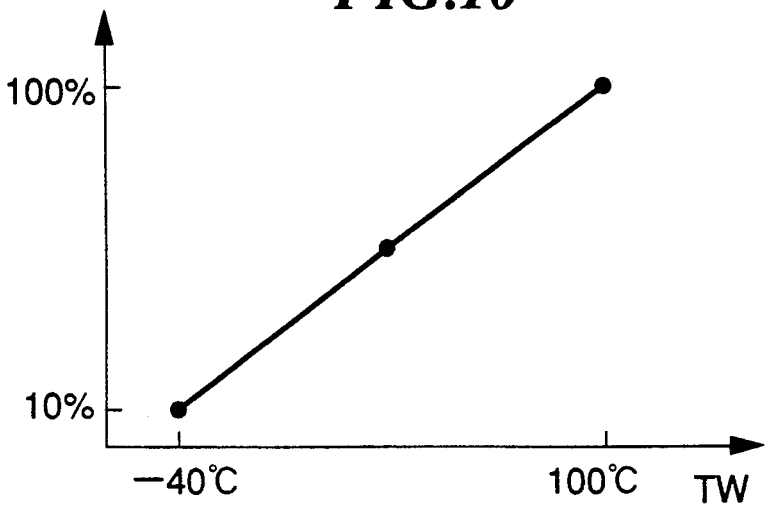
FIG. 10 shows the relationship between an injected free vaporization rate RV and engine coolant temperature TW, which is set in an RV table.

At the next step S3, the read VQT value is substituted into the following equation (1) to calculate a desired vapor flow rate VQCMD which is a desired flow rate of an evaporative fuel component in the mixture flowing in the intake pipe 2 at the start of the engine 1:

$$VQCMD = VQT \times KNE \quad (1)$$

where KNE is an engine speed-dependent correction coefficient which is set depending upon the engine rotational speed NE. The correction coefficient KNE is read from a KNE table as shown in FIG. 10 according to the engine rotational speed NE. By thus multiplying the VQT value by the correction coefficient KNE, a VQCMD value corresponding to the engine rotational speed NE is obtained.

At the next step S4, a calculation is made of the actual flow rate (purging vapor flow rate) VQ of the evaporative fuel component in the mixture flowing in the purging passage 17. The calculation of the purging vapor flow rate VQ is based upon the fact that the purging flow rate calculated based upon the throttle valve opening $\theta$TH and the intake pipe absolute pressure PBA (the flow rate of the mixture flowing in the purging passage 17) and the output value of the hot-wire type flow meter 22 vary with vapor concentration (the concentration of evaporative fuel) in the mixture flowing in the purging passage 17, as explained in detail hereinafter.

The step S4 is followed by a step S5 where it is determined whether or not the EPCV value assumes the maximum value, i.e. whether or not the purge control valve 16 is fully open. If the answer is negative (No), the valve opening period Tout of the fuel injection valve 6 is set to 0 at a step S13, and then it is determined at a step S14 whether or not the purging vapor flow rate VQ is greater than the desired vapor flow rate VQCMD calculated at the step S3.

If the answer to the question of the step S14 is negative (No), i.e. if the calculated vapor flow rate VQ is smaller than the desired vapor flow rate VQCMD, the EPCV value, i.e. the control amount determining the valve opening of the purge control valve 16 is increased from the present value by a value C, at a step S15, in order to increase the vapor supply amount so that an amount of fuel required for the engine to start is supplied to the engine, followed by terminating the program. The value C is a renewal constant for renewing the EPCV value. On the other hand, if the answer to the question of the step 14 is affirmative (Yes), i.e. if the calculated vapor flow rate VQ is greater than the desired vapor flow rate VQCMD, the EPCV value or the control amount for the purge control valve 16 is decreased by the value C at a step S16, to decrease the vapor supply amount, followed by terminating the program.

If the answer to the question of the step S5 is affirmative (Yes), i.e. if the EPCV value assumes the maximum value, a value of an injected fuel vaporization rate RV is read from an RV table which is set in accordance with the engine coolant temperature TW. The RV table is, for example, set as shown in FIG. 10, such that if TW=−40° C., RV=10%, and if TW=100° C., RV=100%.

At the next step S7, a vaporized fuel flow rate IVQ is calculated by the use of the following equation (2):

$$IVQ = IQ \times RV \quad (2)$$

where IQ is a flow rate-equivalent value corresponding to the present value of the fuel injection period Tout, which is calculated on the assumption that 100% of fuel injected by the fuel injection valve 6 is vaporized. Therefore, the vaporized fuel flow rate IVQ represents a flow rate of vaporized fuel obtained from the fuel injected by the fuel injection valve 6 into the intake pipe 2.

At the following step S8, the sum of the vapor flow rate VQ and the vaporized fuel flow rate IVQ is calculated as a total vapor flow rate (flow rate of the total evaporative fuel component in the mixture flowing in the intake pipe 2);

$$TVQ = IVQ + VQ \quad (3)$$

Then, a step S9 is executed to determine whether or not the total vapor flow rate TVQ exceeds the desired vapor flow rate VQCMD. If the answer is negative (No), i.e. if the TVQ value is smaller than the VQCMD value, the fuel injection period Tout of the fuel injection valve 6 is increased from the present value by a value D, at a step S10, to increase the fuel injection amount. The value D is a renewal constant for renewing the fuel injection period Tout. On the other hand, if the answer to the question of the step S9 is affirmative (Yes), i.e. if the TVQ value exceeds the VQCMD value, the fuel injection period Tout is decreased from the present value by the value D, at a step S11.

At the next step S12, it is determined whether or not the Tout value is equal to 0. If the answer is negative (No), the program is immediately terminated, whereas if the answer is affirmative (Yes), the program proceeds to the step S14.

According to the program of FIG. 7 described above, when the purge control valve 16 is not fully open (the answer to the question of the step S5 is negative (No)), the valve opening of the purge control valve 16 alone is controlled so as to make the amount of evaporative fuel supplied to the engine equal to the desired value, whereas when the purge control valve 16 is fully open (the answer to the question of the step is affirmative (Yes)), the valve opening period Tout of the fuel injection valve 6 is also controlled so that the total amount of evaporative fuel, i.e. the sum of the amount of vapor in the fuel injected from the fuel injection valve 6 and the amount of evaporative fuel supplied through the purging passage 17 becomes equal to the desired value.

Figure 11:
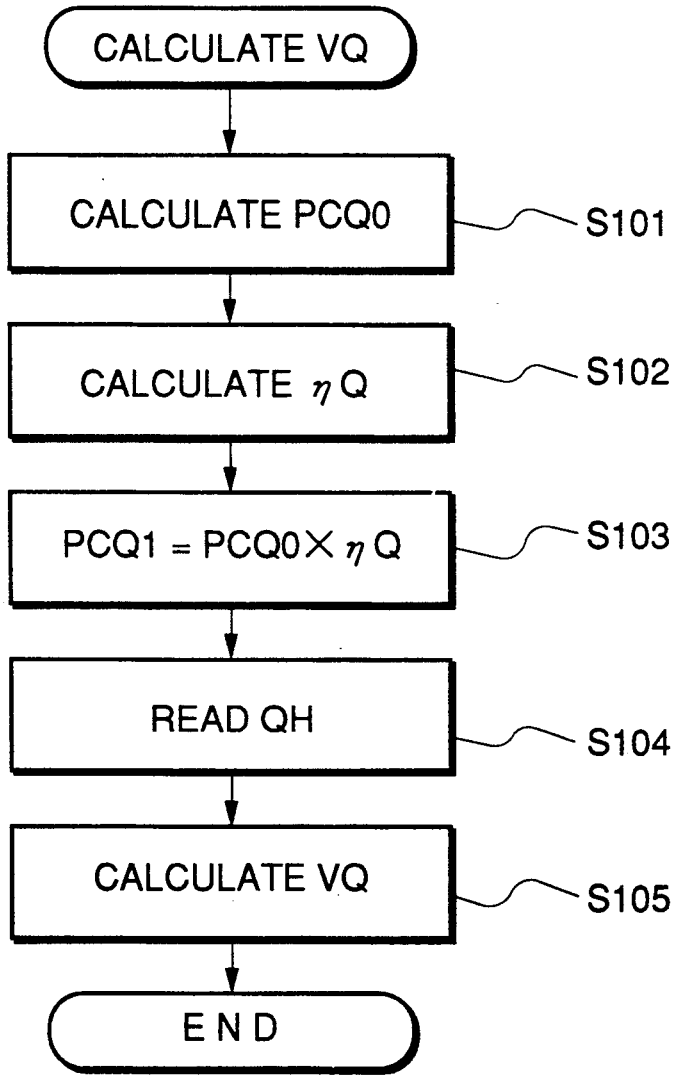
FIG. 11 is a flowchart showing a program for calculating the vapor flow rate VQ and the vapor concentration $\beta$.

FIG. 11 shows a program for calculating the vapor flow rate VQ mentioned hereinabove. At a step S101 in the figure, the basic PC flow rate PCQ0 is determined according to the throttle valve opening $\theta$TH and the intake pipe absolute pressure PBA (see FIG. 2). Then, at a step S102, the flow rate ratio $\eta$Q is determined according to the valve opening degree VS of the purge control valve 16 (see FIG. 3). The basic PC flow rate PCQ0 is read from a PCQ0 map as shown in FIG. 12, in which predetermined PCQ0 values PCQ0(0, 0)~PCQ0(15, 15) are set corresponding to predetermined throttle opening values $\theta$TH0~$\theta$TH15 and predetermined intake pipe absolute pressure values PBA0~PBA15. When the $\theta$TH value and/or the PBA value falls between adjacent predetermined $\theta$TH and/or PBA values, the PCQ0 value is calculated by an interpolation method. The flow rate ratio $\eta$Q is read from a $\eta$Q table as shown in FIG. 13, in which predetermined $\eta$Q values $\eta$Q0~$\eta$Q15 are set corresponding to predetermined valve opening values VS0~VS15. When the VS value falls between adjacent predetermined VS values, the $\eta$Q value is calculated by an interpolation method.

At the next step S103, the PC flow rate PCQ1 is calculated by the use of the following equation (2):

$$PCQ1 = PCQ0 \times \eta Q \quad (2)$$

Then, at a step S104, the output value QH of the hot-wire type mass flowmeter 22 is read in, followed by determining the vapor flow rate VQ according to the QH value and the PCQ1 value through reading from a VQ map and interpolation if required, at a step S105. An example of the VQ map is shown in FIG. 14, which is based upon the relationship of FIG. 6, and in which predetermined VQ values VQ(0, 0)~VQ(15, 15) are set corresponding to predetermined $\theta$H values $\theta$H0~$\theta$H15 and predetermined PCQ1 values PCQ1-0~PCQ1-15.

As described in detail above, according to the invention, the flow rate of the evaporative fuel component in the mixture flowing in the purging passage is detected, and the amount of fuel to be supplied to the engine at the start thereof is set based upon the detected flow rate. Therefore, it is possible to reduce the fuel amount to be injected from the fuel injection valves and hence greatly reduce the excessive amount of fuel supplied to the engine to thereby reduce the HC emissions and curtail the fuel consumption.

What is claimed is:

1. In a starting fuel supply control system for an internal combustion engine having a fuel tank, an intake passage, a canister for absorbing evaporative fuel generated from said fuel tank, a purging passage connecting between said canister and said intake passage for purging a mixture of said evaporative fuel and air therethrough into said intake passage, and a purge control valve arranged across said purging passage for controlling a flow rate of said mixture of said evaporative fuel and air to be supplied to said intake passage, the improvement comprising:

evaporative fuel flow rate-detecting means for detecting a flow rate of an evaporative fuel component in said mixture flowing in said purging passage; and starting fuel amount-setting means for setting an amount of fuel to be supplied to said engine at the start thereof, based upon the detected flow rate of said evaporative fuel component.

2. A starting fuel supply control system as claimed in claim 1, including engine operating parameter-detecting means for detecting values of a plurality of operating parameters of said engine, mixture flow rate-calculating means for calculating a flow rate of said mixture, based upon the detected values of said operating parameters of said engine, and a mass flowmeter arranged across said purging passage, and wherein said evaporative fuel flow rate-detecting means detects said flow rate of said evaporative fuel component in said mixture, based upon the calculated flow rate of said mixture and an output value of said mass flowmeter.

3. A starting fuel supply control system as claimed in claim 1, including injecting means for injecting fuel into said intake passage, and wherein said starting fuel amount-setting means sets said amount of fuel to be supplied to said engine at the start thereof by setting to zero an amount of fuel to be injected by said injecting means and controlling said purge control valve alone when the detected flow rate of said evaporative fuel component in said mixture exceeds a flow rate required for an operating condition of said engine at the start thereof, and by controlling both said purge control valve and said injecting means when the detected flow rate of said evaporative fuel component exceeds said required flow rate.

4. A starting fuel supply control system as claimed in claim 3, wherein said starting fuel amount-setting means comprises means for calculating a rate of vaporization of fuel injected by said injecting means when the detected flow rate of said evaporative fuel component in said mixture is smaller than said required flow rate, means for calculating, based upon the calculated rate of vaporization, a flow rate of vaporized fuel component fuel injected by said injecting means, and means for setting said amount of fuel to be supplied to said engine at the start thereof, based upon a sum of the calculated flow rate of said vaporized fuel component and the detected flow rate of said evaporative fuel.

5. In a starting fuel supply control system for an internal combustion engine having a fuel tank, an intake passage, fuel supply means arranged in said intake passage, a canister for absorbing evaporative fuel generated from said fuel tank, a purging passage connecting between said canister and said intake passage for purging a mixture of said evaporative fuel and air therethrough into said intake passage, and a purge control valve arranged across said purging passage for controlling a flow rate of said mixture of evaporative fuel and air to be supplied to said intake passage, the improvement comprising:

evaporative fuel flow rate-calculating means for calculating a desired flow rate (VQCMD) of an evaporative fuel component in said mixture to flow in said purging passage, based upon predetermined operating parameters of said engine;

evaporative fuel flow rate-detecting means for detecting a flow rate (VQ) of said evaporative fuel component in said mixture flowing in said purging passage; and starting fuel amount-setting means for setting an amount of fuel (Tout) to be supplied to said engine through said fuel supply means at the start thereof, based upon the calculated desired flow rate of said evaporative fuel component and the detected flow rate of said evaporative fuel component, such that a flow rate (TVQ) of a total evaporative fuel component in a mixture of evaporative fuel and air supplied from said fuel supply means and said mixture flowing in said purging passage becomes equal to the calculated desired flow rate (VQCMD) of said evaporative fuel component in said mixture flowing in said purging passage.

* * * * *